US012789064B2

(12) United States Patent
Wade

(10) Patent No.: US 12,789,064 B2
(45) Date of Patent: Nov. 10, 2026

(54) MULTI-GAME SYSTEM

(71) Applicant: Eric N. Wade, Scottsburg, IN (US)

(72) Inventor: Eric N. Wade, Scottsburg, IN (US)

( * ) Notice: Subject to any disclaimer, the term of this patent is extended or adjusted under 35 U.S.C. 154(b) by 324 days.

(21) Appl. No.: 18/586,206

(22) Filed: Feb. 23, 2024

(65) Prior Publication Data

US 2024/0286018 A1 Aug. 29, 2024

Related U.S. Application Data

(60) Provisional application No. 63/486,571, filed on Feb. 23, 2023.

(51) Int. Cl.
*A63B 67/06* (2006.01)

(52) U.S. Cl.
CPC ..... *A63B 67/06* (2013.01); *A63B 2210/50* (2013.01); *A63B 2225/093* (2013.01)

(58) Field of Classification Search
CPC ..... A63B 67/06; A63B 63/00; A63F 9/02
USPC ..... 273/348, 352, 398, 402, 407; 473/195, 473/478
See application file for complete search history.

(56) References Cited

U.S. PATENT DOCUMENTS 406,342 A * 7/1889 Dumont ..... A63B 67/06 273/402
922,717 A * 5/1909 Parker ..... A63B 67/06 273/401
2,618,484 A * 11/1952 Bishop ..... F41J 3/0019 248/455
3,427,026 A * 2/1969 Mahoney ..... A63B 69/0097 273/395
4,625,974 A * 12/1986 Andrews ..... F41J 3/0019 273/404
4,995,611 A 2/1991 Goldthorpe
5,320,360 A * 6/1994 St. Pierre ..... A63F 9/0204 273/402
5,570,889 A * 11/1996 Tyrer ..... A63B 63/00 273/DIG. 30
5,833,234 A * 11/1998 Vavala ..... A63B 69/0097 273/400
6,149,152 A * 11/2000 Mancke ..... A63B 69/002 273/123 R (Continued)

OTHER PUBLICATIONS

"Hot Bee 5-in-1 Hover Hockey Soccer Gifts for Boys 4-8, Sports Basketball Rugby Hockey Toys for 4 5 6 7 8 Years Old Boys" (Amazon) Feb. 24, 2022 (FeB. 24, 2022); retrieved from internet May 13, 2024; URL=<https://www.amazon.com/Hot-Bee-Hockey-Socce••Basketball/dp/B0CB6136WV/ref=cm_cr_arp_d_product_top?ie=UTF8&th=1 >; especially p. 1 para 4-in-1 Activity Center, and p. 1 Inset Figure.

*Primary Examiner* — Joseph B Baldori

(57) ABSTRACT

A multi-game system includes a target board. The target board comprises a front surface, a back surface, a top end surface, a bottom end surface, and a pair of opposite sidewalls. The target board further comprises a primary target hole traversing from the front surface to the back surface. The target board further comprises a plurality of target board legs extending from the bottom end surface of the target board. The target board further comprises a pair of lower support leg pivotably attached to the pair of sidewalls of the target board at a middle portion of the sidewalls, allowing a tilt angle of the target board to change as the pair of lower support leg pivots.

20 Claims, 17 Drawing Sheets

(56) References Cited

U.S. PATENT DOCUMENTS 6,458,048 B1 * 10/2002 McGrath ..... A63B 69/0002 473/456
6,502,819 B2 * 1/2003 Rieber ..... A63D 15/04 273/108
7,523,942 B2 * 4/2009 Chung ..... A63B 71/0669 273/317.1
7,607,666 B1 10/2009 Studier
7,775,525 B2 * 8/2010 Staver ..... A63B 67/06 273/317.1
8,091,895 B2 * 1/2012 Allen ..... F41J 1/10 108/4
8,096,557 B2 * 1/2012 Lin ..... A63B 63/00 273/371
8,678,957 B1 * 3/2014 Essex ..... A63B 71/022 473/456
8,807,569 B1 * 8/2014 Davis ..... F41J 5/20 473/570
8,900,074 B1 * 12/2014 Johnson ..... A63B 63/00 473/422
9,067,114 B2 * 6/2015 Deming ..... F41J 5/04
9,155,952 B2 * 10/2015 Yamanashi ..... A63B 69/0097
9,533,210 B2 * 1/2017 Lee ..... A63B 71/0054
9,550,101 B2 * 1/2017 Janeri ..... A47C 15/004
9,687,709 B2 * 6/2017 Riniti ..... A63B 63/08
9,844,721 B2 * 12/2017 Pavey ..... A63F 7/06
9,950,230 B2 4/2018 Silva et al.
10,130,859 B1 * 11/2018 Riley ..... A63B 69/0097
10,220,281 B2 * 3/2019 Luo ..... A63B 71/0605
10,406,416 B2 * 9/2019 Cohen ..... A63B 67/02
10,427,019 B2 * 10/2019 Schmidt ..... A63B 63/08
10,881,932 B2 * 1/2021 Burns ..... A63B 67/06
11,033,790 B2 * 6/2021 Manou ..... A63B 63/08
12,318,673 B2 * 6/2025 Curtis ..... A63B 67/06
D1,085,239 S * 7/2025 Wade ..... D21/303
12,427,386 B2 * 9/2025 Lombardini ..... A63B 67/06
2005/0134001 A1 * 6/2005 Rowan ..... A63B 63/004 273/401
2008/0007005 A1 * 1/2008 Hsiao ..... A63B 63/00 273/390
2009/0051133 A1 * 2/2009 Oshiro ..... B62B 3/02 273/348
2009/0115136 A1 * 5/2009 Voden ..... A63B 21/0054 273/245
2010/0081513 A1 * 4/2010 La Pointe ..... A63B 69/3623 473/197
2011/0074111 A1 * 3/2011 Jackson ..... A63F 9/0204 273/400
2011/0074112 A1 3/2011 Allen
2014/0121040 A1 * 5/2014 Cappello ..... A63B 69/00 473/422
2014/0145401 A1 * 5/2014 Powers ..... A63B 67/06 273/402
2014/0183823 A1 7/2014 Deming et al.
2014/0333028 A2 * 11/2014 Nally ..... A63B 67/06 273/402
2016/0008689 A1 * 1/2016 Janeri ..... A47C 4/08 273/402
2016/0144256 A1 * 5/2016 Lee ..... A63B 24/0021 473/416
2018/0256954 A1 9/2018 Schmidt
2021/0086049 A1 3/2021 Manou
2021/0236897 A1 * 8/2021 Eanniello ..... A63B 63/08
2021/0260456 A1 8/2021 Lombardini
2023/0173360 A1 6/2023 Curtis
2023/0191218 A1 * 6/2023 Alvarez ..... A63B 67/06 273/400
2024/0286018 A1 * 8/2024 Wade ..... A63B 63/00

* cited by examiner

MULTI-GAME SYSTEM

FIELD OF THE INVENTION

The present invention relates generally to recreational game devices. More specifically, the present invention is a multi-game system. The present invention is specifically designed for multi-games. However, the present invention is not limited to this option, and it may further be adapted for different purposes.

BACKGROUND OF THE INVENTION

Toss games, such as horseshoes and ring toss, are well known forms of amusement that are often enjoyed in parks, beaches, etc. One of the benefits of these multi-games is that they tend to be small and lightweight components that can be readily taken on these types of social outings.

However, there are some drawbacks associated with the existing toss games. For example, the existing toss game device can merely provide a single type of game activity to users. Moreover, the multi-game cannot provide different degrees of difficulty. In addition, the game device is usually large and bulky.

Therefore, it is an objective of the present invention to provide a multi-game system which overcomes the problems set forth above.

SUMMARY OF THE INVENTION

The present invention discloses a multi-game system that includes a target board. The target board comprises a front surface, a back surface, a top end surface, a bottom end surface, and a pair of opposite sidewalls. The target board further comprises a primary target hole traversing from the front surface to the back surface. The target board further comprises a plurality of target board legs extending from the bottom end surface of the target board. The target board further comprises a pair of lower support leg pivotably attached to the pair of sidewalls of the target board at a middle portion of the sidewalls, allowing a tilt angle of the target board to change as the pair of lower support leg pivots.

In one embodiment, the target board further comprises a plurality of secondary target holes traversing from the front surface to the back surface, and the plurality of secondary target holes is smaller than the primary target hole.

In one embodiment, the target board further comprises a plurality of top poles extending from the top end surface of the target board.

In one embodiment, the plurality of top poles is telescopic poles.

In one embodiment, each of the plurality of top poles comprises a detachable end cap.

In one embodiment, the target board further comprises a top net attached between the plurality of top poles.

In one embodiment, the pair of lower support legs is telescopic legs.

In one embodiment, the target board further comprises a pair of upper support legs pivotably attached to the pair of sidewalls of the target board at a location adjacent to the top end surface of the target board.

In one embodiment, the pair of upper support legs is telescopic legs.

In one embodiment, each of the pair of lower support leg comprises a first locking mechanism to prevent the pair of lower support leg from pivoting, and each of the pair of upper support legs comprises a second locking mechanism to prevent the pair of upper support legs from pivoting.

In one embodiment, the target board further comprises a center support leg attached to the back surface of the target board via a hinge.

In one embodiment, the center support leg is a telescopic leg.

In one embodiment, the target board further comprises a hoop removably attached to the front surface of the target board.

In one embodiment, the multi-game system further comprises a base board. The base board comprises a top surface, a bottom surface, an upper end surface, and a pair of opposite sidewalls. A plurality of base legs extends from the bottom surface of the base board, adjacent to the upper end surface of the base board, such that the top surface is oriented at an angle with respect to a ground surface.

In one embodiment, the base board further comprises a ramp board having a top surface, front end surface, and a pair of opposite sidewalls, and the top surface of the base board further comprises a cutout portion that has a shape complementary to the ramp board such that the top surface of the base board and the top surface of the ramp board form a planar surface when the ramp board is received within the cutout portion.

In one embodiment, the ramp board is tiltable relative to the base board such that the top surface of the ramp board is oriented at an angle with respect to the top surface of the base board.

In one embodiment, the base board further comprises an angle adjustment mechanism. The angle adjustment mechanism comprises a first adjustment pin on a sidewall of the ramp board, a second adjustment pin on a sidewall of the base board, and an angle adjustment bar having a plurality of adjustment holes to receive the first adjustment pin and the second adjustment pin, In one embodiment, the first adjustment pin and second adjustment pin are threaded, and each of the first adjustment pin and second adjustment pin is provided with a wingnut to hold the angle adjustment mechanism in position.

In one embodiment, the base board further comprises a ramp board locking mechanism. The ramp board locking mechanism comprises a first locking pin on the front end surface of the ramp board, a second locking pin on the upper end surface of the base board, and a locking bar having two locking holes to receive the first locking pin and the second locking pin respectively.

In one embodiment, the first locking pin and the second locking pin are threaded, and each of the first locking pin and the second locking pin is provided with a wingnut to lock the ramp board in the cutout portion.

BRIEF DESCRIPTION OF THE DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the present invention. That is, the dimensions of the components of the present invention, independently and in relation to each other can be different. It should be noted that the drawings are schematic and not necessarily drawn to scale. Some drawings are enlarged or reduced to improve drawing legibility.

DETAIL DESCRIPTIONS OF THE INVENTION

Figure 1:
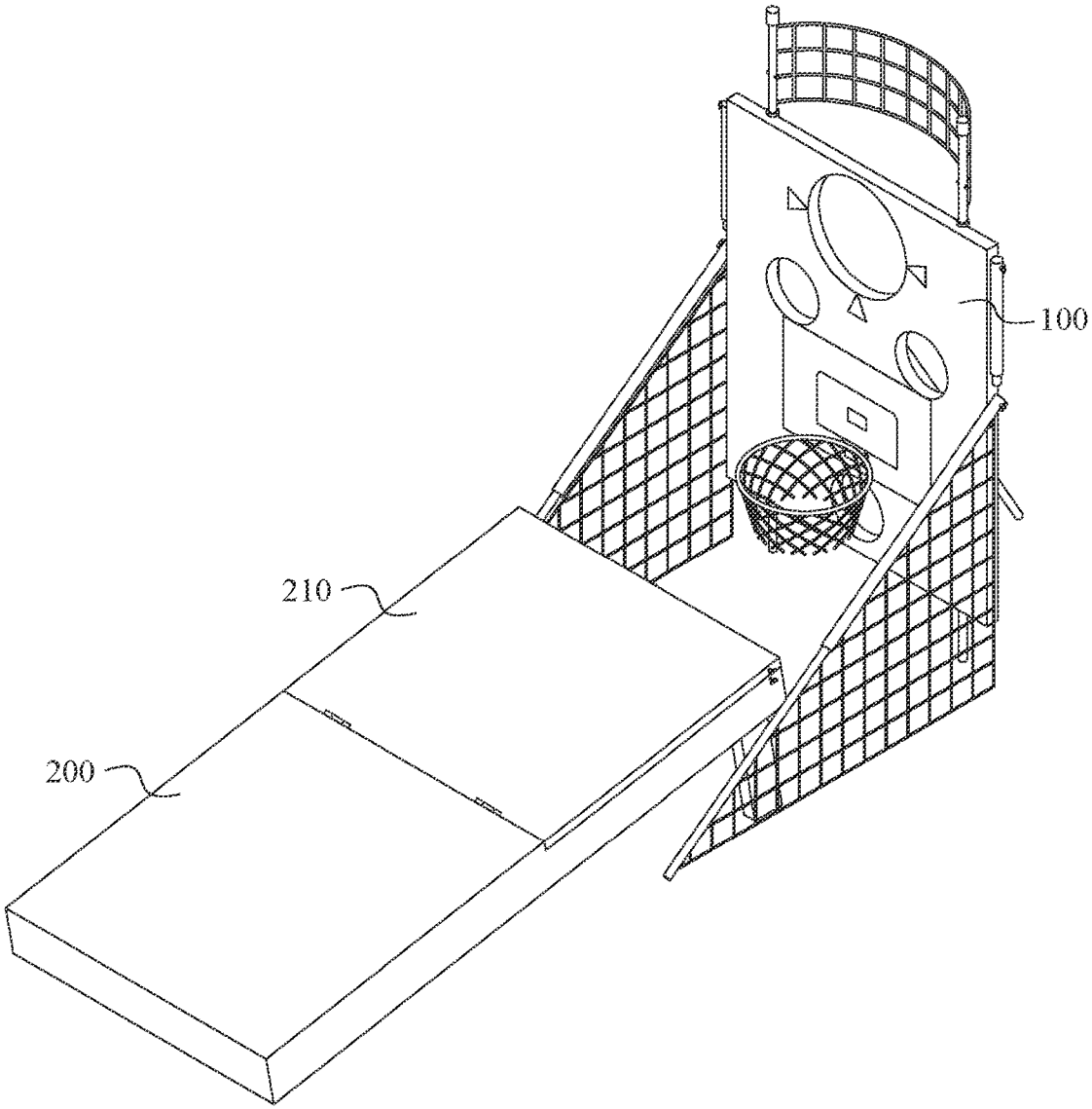
FIG. 1 depicts a perspective view of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and is made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. When not explicitly defined herein, to the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subject matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "proximate" refers to positions that are situated close/near in relationship to a structure. As used in the following description, the term "distal" refers to positions that are situated away from positions.

The present disclosure includes many aspects and features. Moreover, while many aspects and features relate to, and are described in the context of multi-game system, embodiments of the present disclosure are not limited to use only in this context.

The present invention is a multi-game system. It is an aim of the present invention to provide a multi-game system that incorporates multiple game activities. It is another aim of the present invention to provide a multi-game system that is collapsible and/or foldable for easy storage or transport, while still providing a stable platform for gameplay.

Referring now to the figures of the present disclosure. FIG. 1 is a schematic view illustrating the components of the present invention. The multi-game system comprises a target board 100.

As shown in FIGS. 1-11, the target board 100 may provide a plurality of game configurations. It should be noted that the target board 100 can be of any shape, size, material, features, type or kind, orientation, location, quantity, components, and arrangements of components that would allow the present invention to fulfill the objectives and intents of the present invention. In a preferred embodiment, the target board 100 has a rectangular shape. The target board 100 comprises a front surface 101, a back surface 102, a top end surface 103, a bottom end surface 104, and a pair of opposite sidewalls 105. The target board 100 further comprises a primary target hole 107 traversing from the front surface 101 to the back surface 102. In one embodiment, the target board 100 further comprises a plurality of secondary target holes 108 traversing from the front surface 101 to the back surface 102. In the illustrated embodiment, the primary target hole 107 is located adjacent to the top end surface 103 of the target board 100. Moreover, the plurality of secondary target holes 108 is smaller than the primary target hole 107. In the illustrated embodiment, the plurality of secondary target holes 108 comprises three holes, with one located adjacent to the bottom end surface 104 of the target board 100 and two located in the middle of the target board adjacent to the sidewalls 105 of the target board 100 respectively. Although in the illustrated embodiment, the primary target hole 107 and the plurality of secondary target holes 108 are circular holes, it is contemplated that other shapes may also be employed.

In one embodiment, the target board 100 further comprises a plurality of top poles 140 extending from the top end surface 103 of the target board 100. Preferably, the plurality of top poles 140 is telescopic poles. The plurality of top poles 140 may be used as ring toss poles. The target board 100 may further comprise a top net 144 attached between the plurality of top poles 140. Moreover, each of the plurality of top poles 140 may comprise an end cap 142 that is detachable. The detachable end caps 142 allow the top net 144 to be attached to or removed from the plurality of top poles 140 with case. In one embodiment, the target board 100 further comprises a hoop 148 removably attached to the front surface 101 of the target board 100. It is to be noted that the primary target hole 107, the plurality of secondary target holes 108, the plurality of top poles 140, the top net 144, and the hoop 148 can all be used as throw targets separately or simultaneously so as to provide multiple game modes. Moreover, the target board 100 of the present invention may be tilted at different angles to provide a variety of difficult levels to users. It is worth noting that when the target board 100 is tilted, the hoop 148 may be used as an obstacle to toss through or around. Moreover, the hoop 148 may be attached to or removed from the front surface 101 of the target board 100 via any suitable means known in the art, including but not limited to bolts, hook and loop fasteners, etc.

Figure 2:
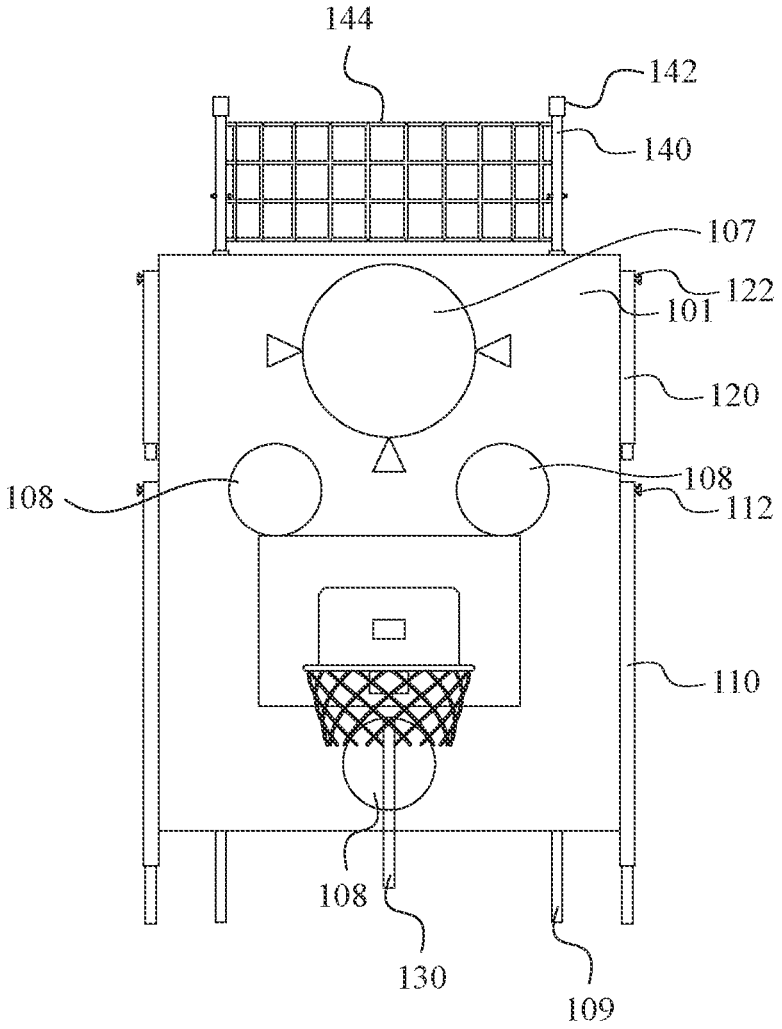
FIG. 2 depicts a front view of the target board of the present invention, wherein the target board is in its storage position.
Figure 3:
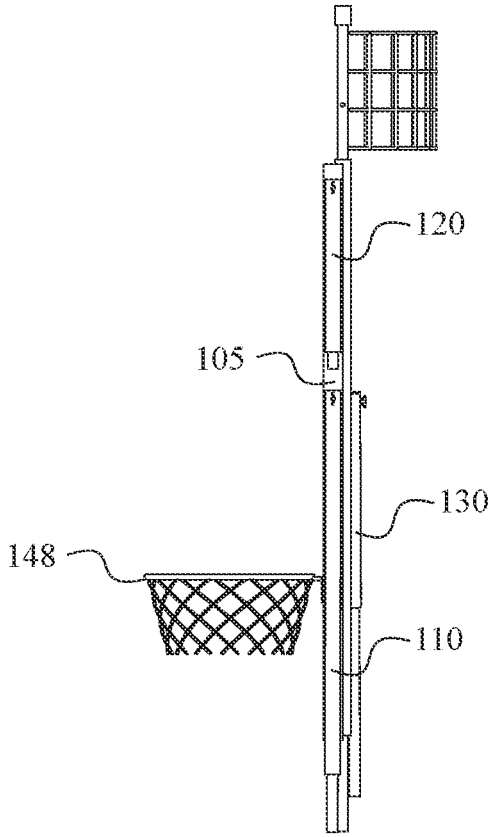
FIG. 3 depicts a right-side view of the target board of the present invention, wherein the target board is in its storage position.
Figure 5:
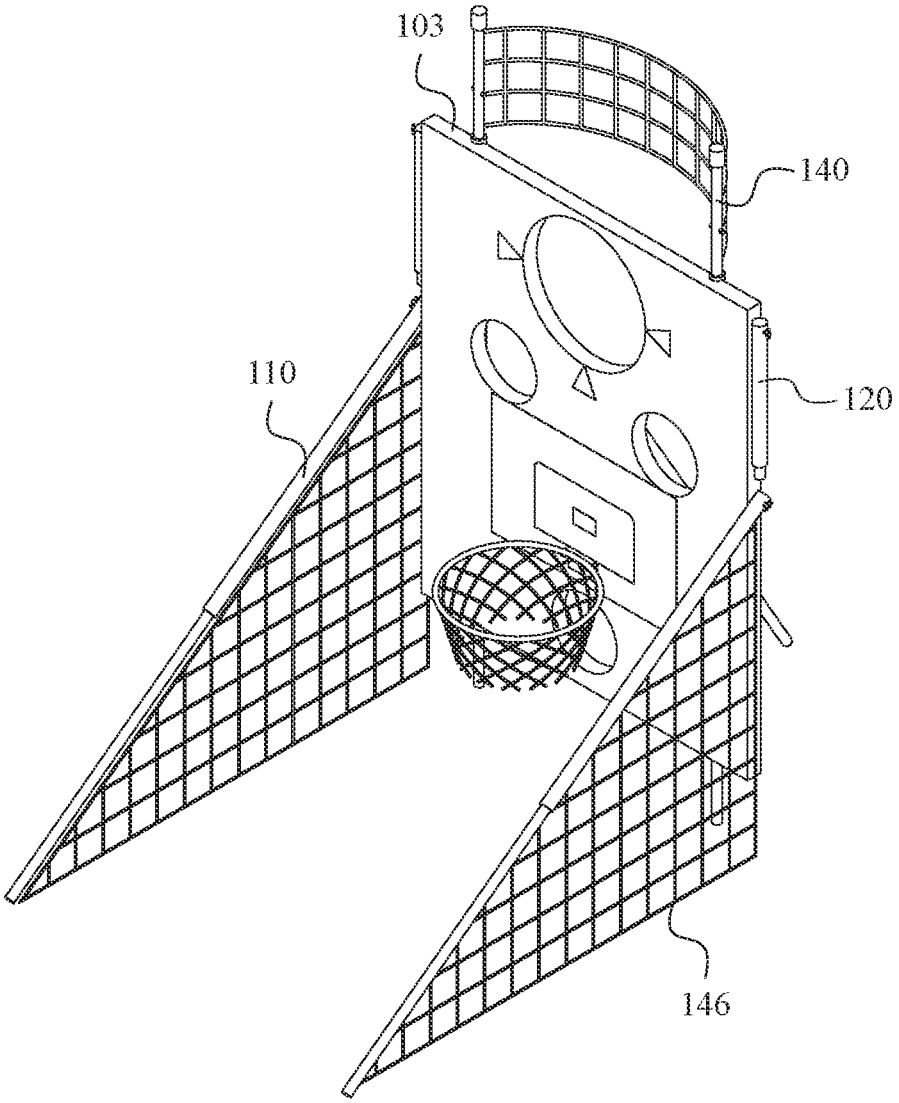
FIG. 5 depicts a perspective view of the target board of the present invention, wherein the target board is in a second deployed position.
Figure 6:
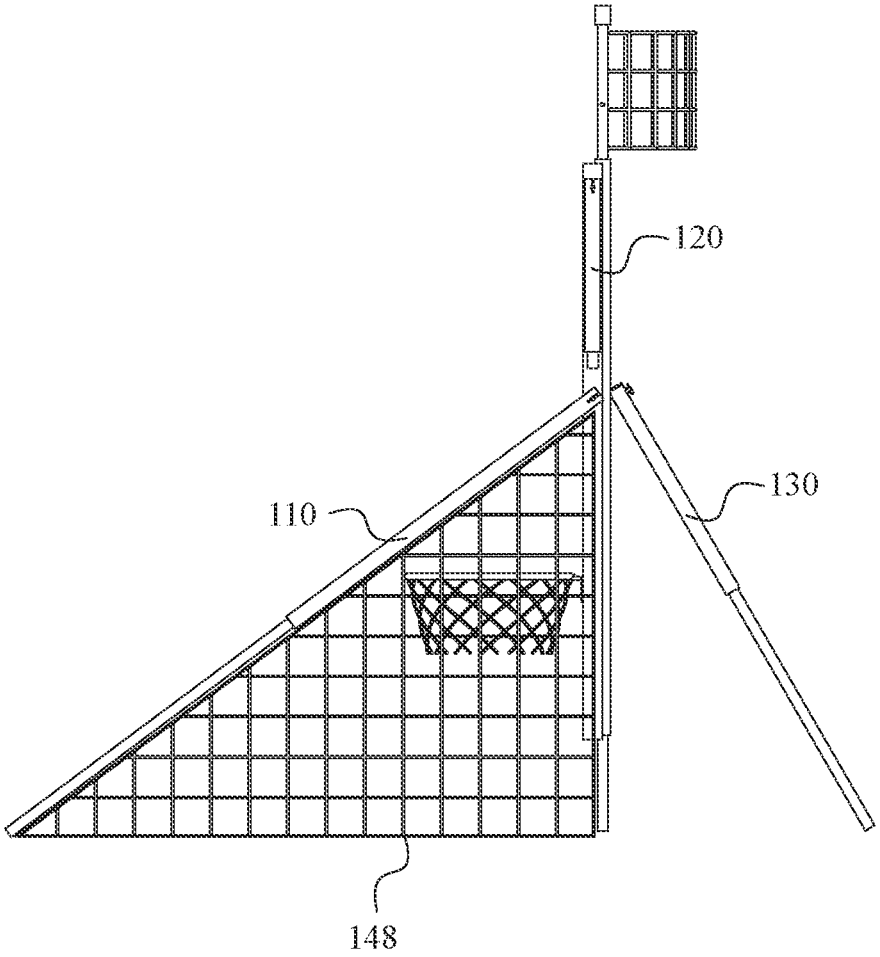
FIG. 6 depicts a right-side view of the target board of the present invention, wherein the target board is in a second deployed position.
Figure 7:
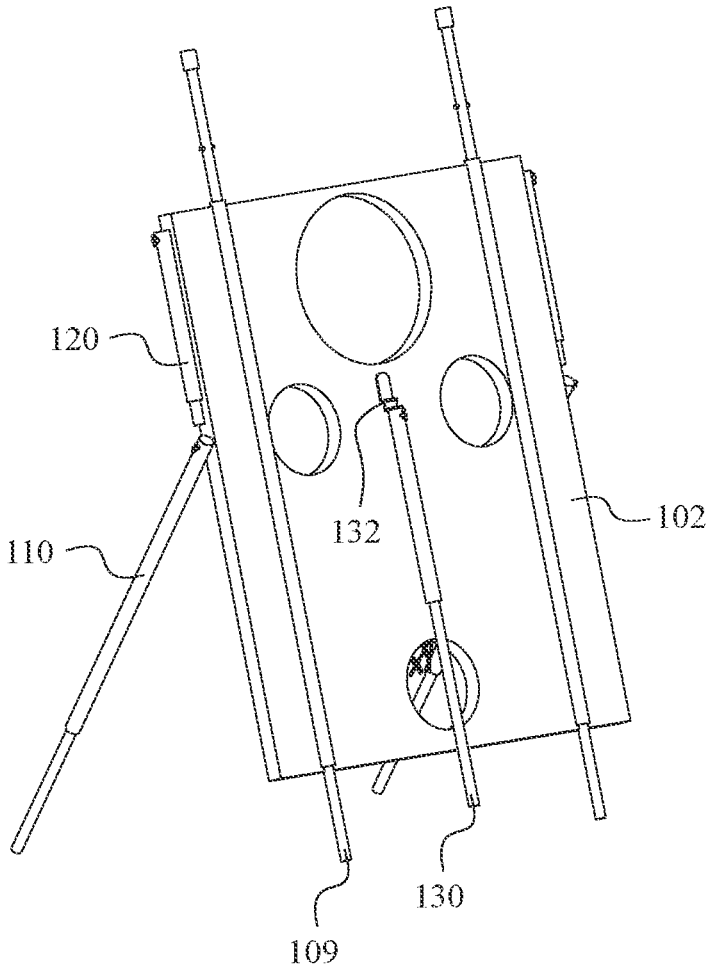
FIG. 7 depicts a perspective view of the target board of the present invention, wherein the target board is in a third deployed position.
Figure 8:
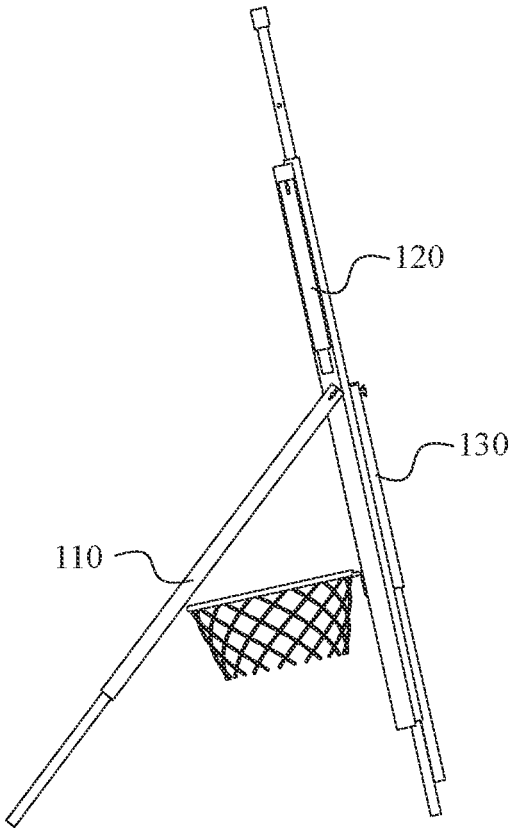
FIG. 8 depicts a right-side view of the target board of the present invention, wherein the target board is in a third deployed position.
Figure 9:
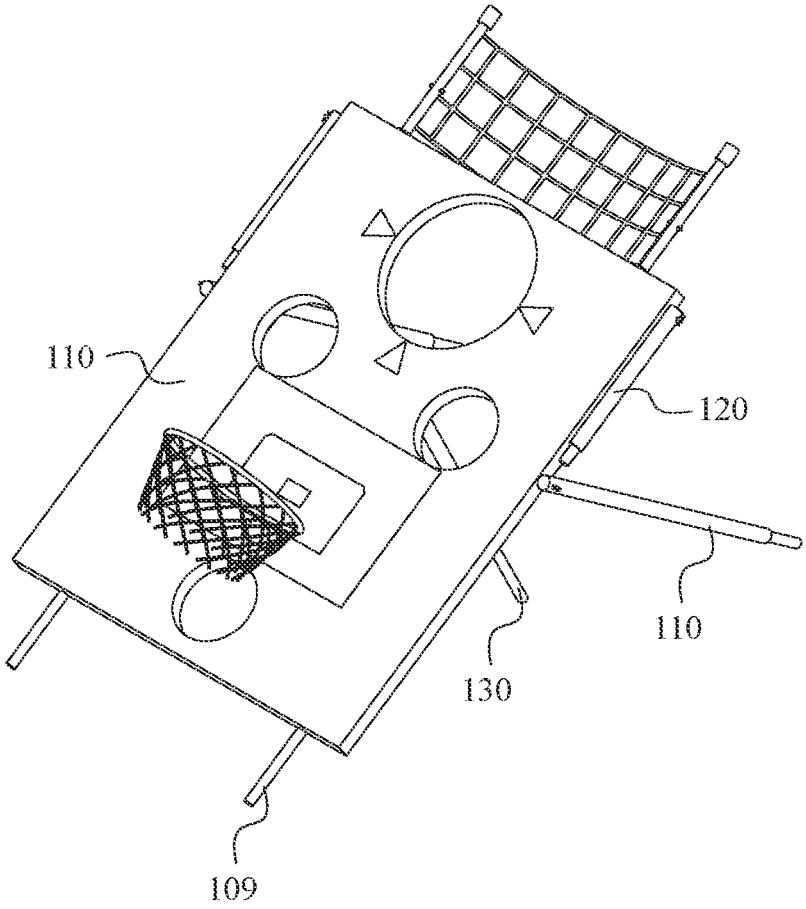
FIG. 9 depicts a perspective view of the target board of the present invention, wherein the target board is in a fourth deployed position.
Figure 10:
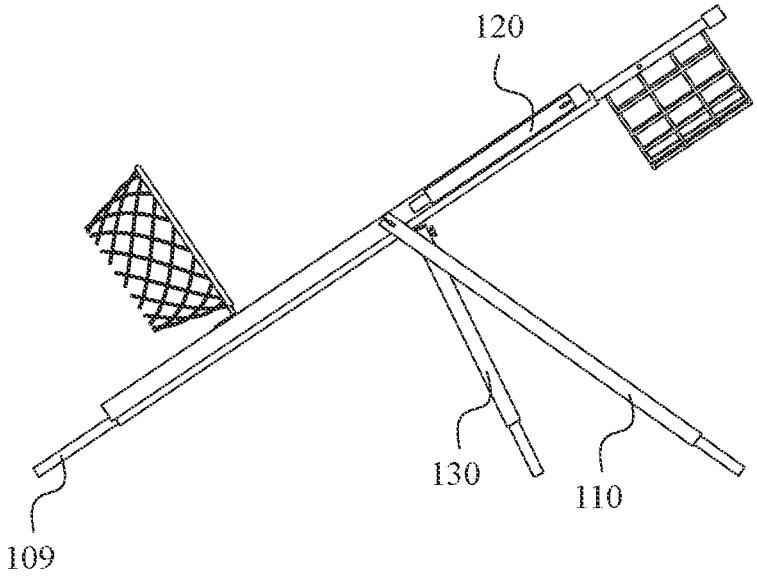
FIG. 10 depicts a right-side view of the target board of the present invention, wherein the target board is in a fourth deployed position.

In one embodiment, the target board 100 further comprises a plurality of target board legs 109 extending from the bottom end surface 104 of the target board 100. The plurality of target board legs 109 provides main support to the target board 100. In a preferred embodiment, the plurality of target board legs 109 is telescopic legs allowing the height of the target board 100 to be adjusted. In one embodiment, the target board 100 further comprises a pair of lower support leg 110 pivotably attached to the pair of sidewalls 105 of the target board 100 at a middle portion of the sidewalls 105, allowing a tilt angle of the target board 100 to change as the pair of lower support leg 110 pivots. The pair of lower support leg 110 can pivot to a storage position where the pair of lower support leg 110 is parallel with the longitudinal edges of the sidewalls 105 of the target board 100, as shown in FIGS. 2-3. The pair of lower support leg 110 can also pivot to different deployed positions where the pair of lower support leg 110 support the target board 100. Preferably, the pair of lower support leg 110 is telescopic legs. When the target board 100 tilts forward, as shown in FIGS. 7-8, the pair of lower support leg 110, together with the plurality of target board legs 109, provides steady support to the target board 100. In one embodiment, the target board 100 may further comprise a plurality of side nets 146 attached to the pair of lower support leg 110, as shown in FIGS. 5-6, such that the target board 100 may be used as a soccer goal.

Figure 4:
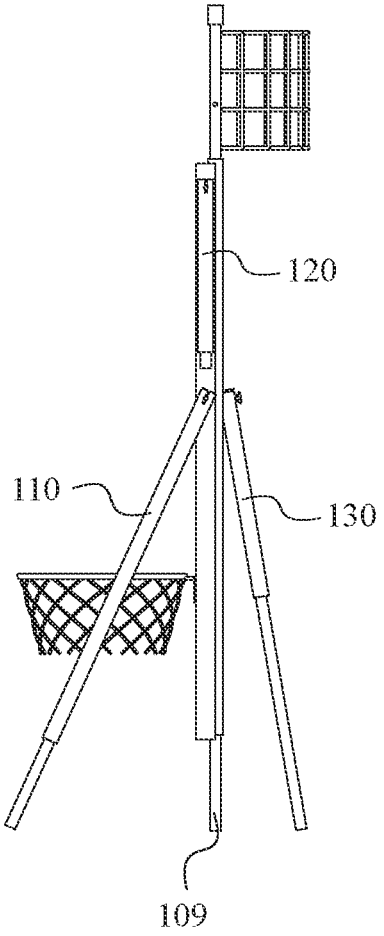
FIG. 4 depicts a right-side view of the target board of the present invention, wherein the target board is in a first deployed position.

In some embodiment, the target board 100 further comprises a center support leg 130 attached to the back surface 102 of the target board 100 via a hinge 132. The center support leg 130 is configured to provide auxiliary support to the target board 100, especially when the target board 100 tilts backward, as shown in FIGS. 4-6 and 9-10. The center support leg 130 can pivot about the hinge 132 to a storage position where the center support leg 130 abuts against the back surface 102 of the target board 100, as shown in FIGS. 3-4. The center support leg 130 can also pivot to different deployed positions where the center support leg 130 forms different angles with respect to the back surface 102 of the target board 100. In a preferred embodiment, the center support leg 130 is a telescopic leg. In this way, the length and/or angle of the center support leg 130 may be adjusted in accordance with different height/angle of the target board 100 so as to facilitate a steady target board 100. In one embodiment, the back surface 102 of the target board 100 may be provided with a strap, allowing for easy transport when carrying.

Figure 11:
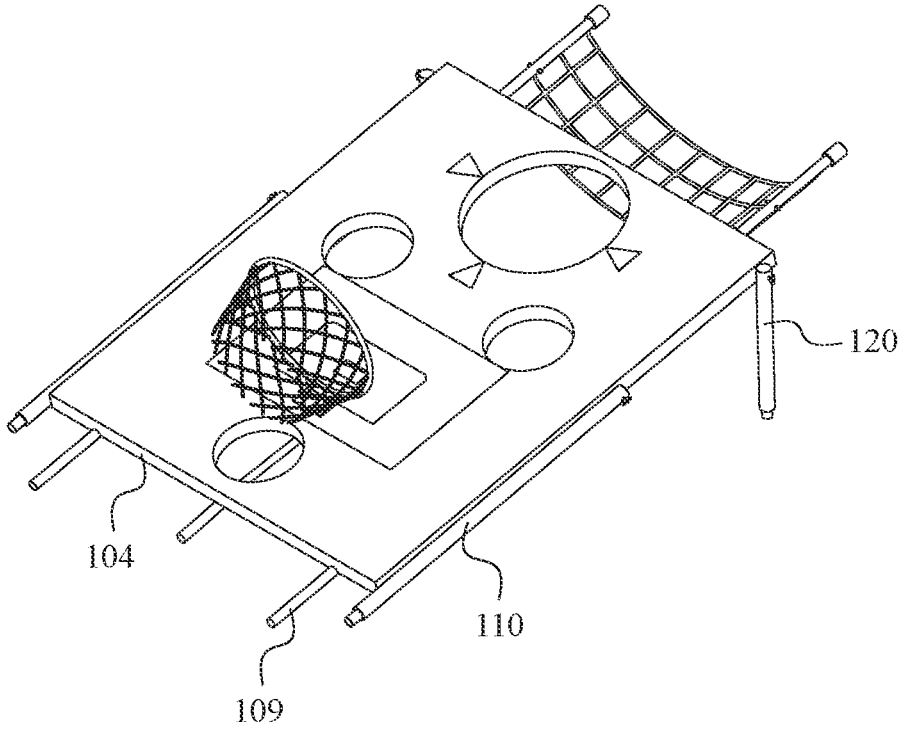
FIG. 11 depicts a perspective view of the target board of the present invention, wherein the target board is in a fifth deployed position.
Figure 12:
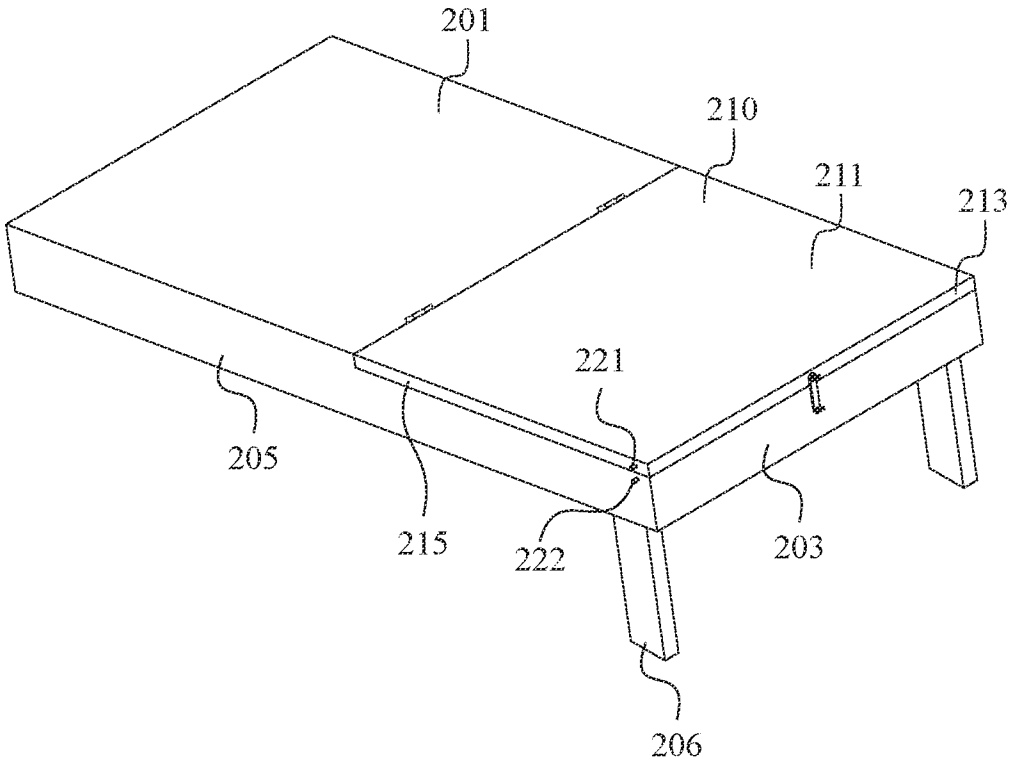
FIG. 12 depicts a perspective view of the base board of the present invention.

The target board 100 further comprises a pair of upper support legs 120 pivotably attached to the pair of sidewalls 105 of the target board 100 at a location adjacent to the top end surface 103 of the target board 100. Similar to the pair of lower support leg 110, the pair of upper support legs 120 can pivot to a storage position where the pair of upper support legs 120 is parallel with the longitudinal edges of the sidewalls 105 of the target board 100, as shown in FIGS. 3-4. The pair of upper support legs 120 can also pivot to a deployed positions where the pair of upper support legs 120 is perpendicular to the ground to provide support to the target board 100 when the angle of the target board 100 with respect to the ground is relatively small (e.g., 10 to 30 degrees), as shown in FIG. 11. Preferably, the pair of upper support legs 120 is telescopic legs. In the present invention, the legs/poles may adopt any suitable telescopic mechanism known in the art as the adjustment means that permits a simple and inexpensive length variation of the legs/poles. For example, the telescopic mechanism may comprise multiple tubes that are slidably engaged to each other and lockable at predetermined positions via spring buttons.

Moreover, the pair of upper support legs 120 can be used as ring toss poles in addition to the plurality of top poles 140 when the pair of upper support legs 120 is not used to support the target board 100. In a preferred embodiment, each of the pair of lower support leg 110 comprises a first locking mechanism 112 to prevent the pair of lower support leg 110 from pivoting, and each of the pair of upper support legs 120 comprises a second locking mechanism 122 to prevent the pair of upper support legs 120 from pivoting. In the abovementioned embodiment, the configuration of the pair of lower support leg 110, pair of upper support legs 120, and center support leg 130 allow the target board 100 to tilt at different angles, as shown in FIGS. 4-11. For example, the angle of the target board 100 with respect to the ground may range from 10 degrees to 170 degrees.

In one embodiment, the multi-game system of the present invention may further comprise a base board 200, as shown in FIGS. 1, and 12-15. It is to be noted that the target board 100 can be used solely or in combination with the target board 100 depending on the user's preference. It should also be noted that the base board 200 can be of any shape, size, material, features, type or kind, orientation, location, quantity, components, and arrangements of components that would allow the present invention to fulfill the objectives and intents of the present invention. In one embodiment, the base board 200 comprises a top surface 201, a bottom surface 202, an upper end surface 203, and a pair of opposite sidewalls 205. A plurality of base legs 206 extends from the bottom surface 202 of the base board 200, adjacent to the upper end surface 203 of the base board 200, such that the top surface 201 is oriented at an angle with respect to a ground surface. In one embodiment, the plurality of base legs 206 comprises two base legs. In a preferred embodiment, the plurality of base legs 206 are foldable legs to make the base board 200 more compact when not in use. In another preferred embodiment, the base board 200 may further comprise one or more handles located on the sidewalls 205 and/or the upper end surface 203. In this way, the users can carry the base board 200 around with case.

The base board 200 may further comprise a ramp board 210 having a top surface 211, a front end surface 213 and a pair of opposite sidewalls 215. The top surface 201 of the base board 200 may further comprise a cutout portion 207 that has a shape complementary to the ramp board 210 such that the top surface 201 of the base board 200 and the top surface 211 of the ramp board 210 form a planar surface when the ramp board 210 is received within the cutout portion 207.

Figure 14:
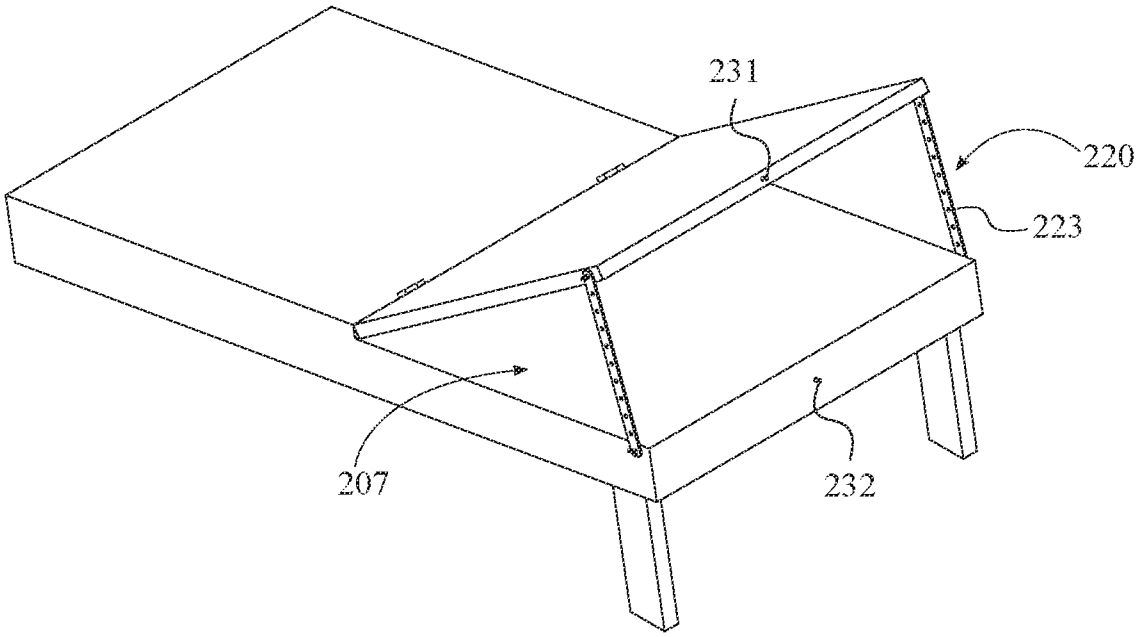
FIG. 14 depicts a perspective view of the base board of the present invention, where the ramp board is fully lifted.
Figure 15:
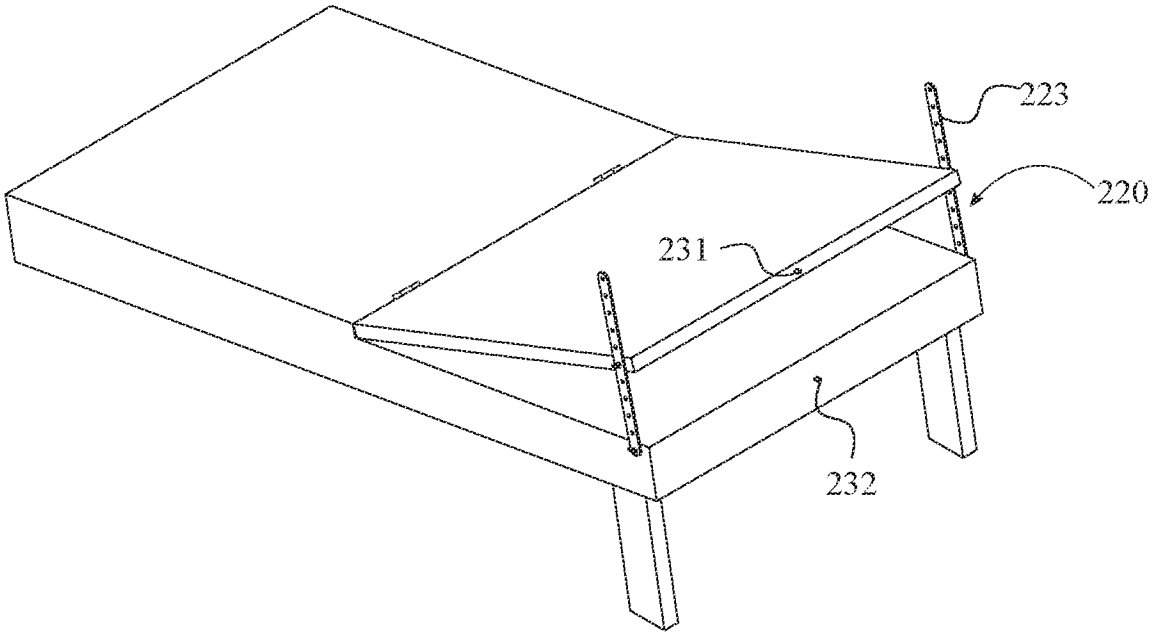
FIG. 15 depicts a perspective view of the base board of the present invention, where the ramp board is partially lifted.
Figure 16:
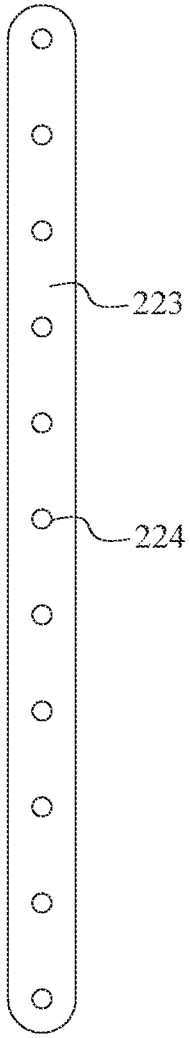
FIG. 16 depicts a front view of the angle adjustment bar of the present invention.

The ramp board 210 is tiltable relative to the base board 200 such that the top surface 211 of the ramp board 210 is oriented at an angle with respect to the top surface 201 of the base board 200. In one embodiment, the ramp board 210 is connected to the base board 200 via a plurality of hinges to allow the ramp board 210 to tilt with respect to the base board 210, as shown in FIGS. 1, 12, 14, and 15. Although the plurality of hinges is shown to be located on the top surface 211 of the ramp board 210 and the top surface 201 of the base board 200, it is to be understood that the plurality of hinges can also be positioned between ramp board 210 and the base board 200, below the top surface 211 of the ramp board 210 and the top surface 201 of the base board 200. The ramp board 210 provides an angled ramp for tossed objects (e.g., toss bags, frisbees, toss ring, etc.). The base board 200 further comprises an angle adjustment mechanism 220 configured to adjust the tilt angle of the ramp board 210. The angle adjustment mechanism 220 comprises a first adjustment pin 221 on a sidewall of the ramp board 210, a second adjustment pin 222 on a sidewall of the base board 200, and an angle adjustment bar 223 having a plurality of adjustment holes 224 to receive the first adjustment pin 221 and the second adjustment pin 222, as shown in FIGS. 14-16. In a preferred embodiment, the first adjustment pin 221 and second adjustment pin 222 are threaded, and each of the first adjustment pin 221 and second adjustment pin 222 is provided with a wingnut 225 to hold the angle adjustment mechanism 220 in position. Preferably, both sides of base board 200 are provided with the angle adjustment mechanism 220 to ensure steady support.

Figure 13:
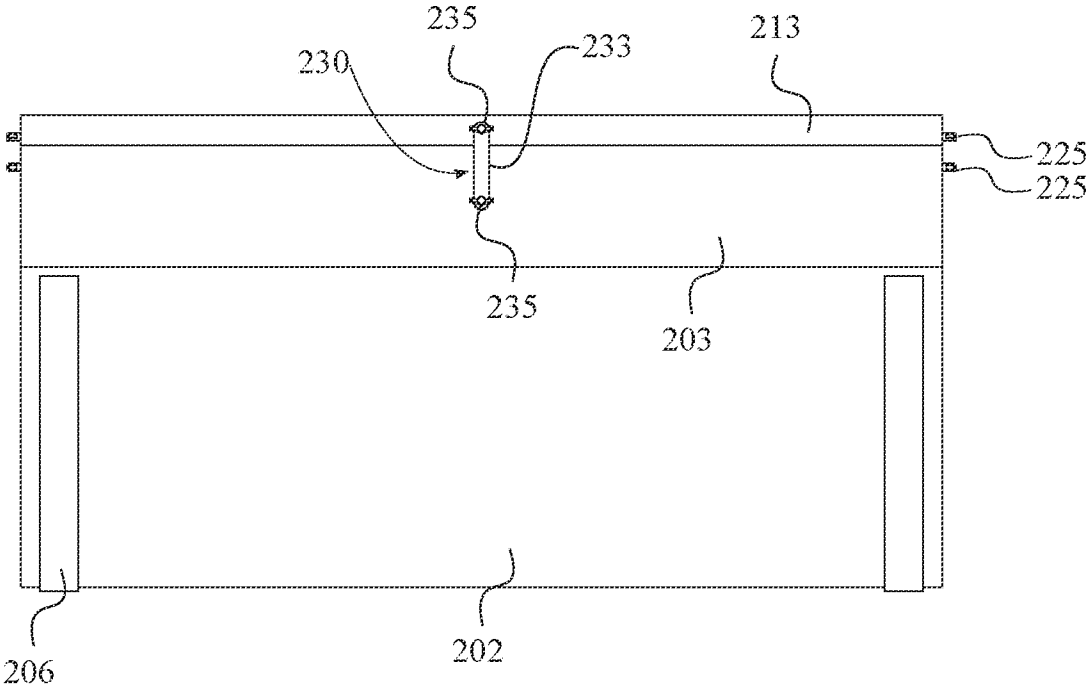
FIG. 13 depicts a front view of the base board of the present invention.
Figure 17:
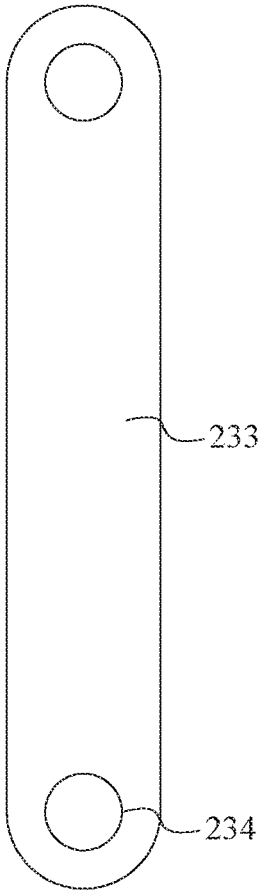
FIG. 17 depicts a front view of the locking bar of the present invention.

In one embodiment, the base board 200 further comprises a ramp board locking mechanism 230 configured to prevent the ramp board 210 from tilting when the ramp board 210 is received within the cutout portion 207. The ramp board locking mechanism 230 comprises a first locking pin 231 on the front end surface 213 of the ramp board 210, a second locking pin 232 on the upper end surface 203 of the base board 200, and a locking bar 233 having two locking holes 234 to receive the first locking pin 231 and the second locking pin 232 respectively, as shown in FIGS. 13 and 17. In a preferred embodiment, the first locking pin 231 and the second locking pin 232 are threaded, and each of the first locking pin 231 and the second locking pin 232 is provided with a wingnut 235 to lock the ramp board 210 in the cutout portion 207.

It is envisioned that the sizes of the components forming the present invention such as the target board 100, base board 200, and/or their subcomponents can vary based on design requirements.

Although the disclosure has been explained in relation to its preferred embodiment, it is to be understood that many other possible modifications and variations can be made without departing from the spirit and scope of the disclosure.

What is claimed is:

1. A multi-game system comprising:

a target board comprising a front surface, a back surface, a top end surface, a bottom end surface, a pair of opposite sidewalls, a primary target hole traversing from the front surface to the back surface, and a plurality of secondary target holes traversing from the front surface to the back surface, wherein the plurality of secondary target holes is smaller than the primary target hole;

a plurality of target board legs extending from the bottom end surface of the target board;

a pair of lower support legs pivotably attached to the pair of sidewalls of the target board at a middle portion of the sidewalls, allowing a tilt angle of the target board to change as the pair of lower support leg pivots;

a pair of upper support legs pivotably attached to the pair of sidewalls of the target board at a location adjacent to the top end surface of the target board, wherein the pair of upper support legs is positioned above the pair of lower support legs on the pair of sidewalls;

a center support leg attached to the back surface of the target board via a hinge;

a plurality of side nets, wherein each side net of the plurality of side nets is attached to a respective lower support leg and a respective sidewall of the target board, such that each side net, the respective lower support leg, and the respective sidewall form a triangle, with an apex of the triangle at a pivot point where the respective lower support leg is pivotably attached to the respective sidewall; and a hoop removably attached to the front surface of the target board.

2. The multi-game system as claimed in claim 1, wherein the plurality of secondary target holes comprises three holes, with one hole located adjacent to the bottom end surface of the target board and two holes located adjacent to the side walls of the target board respectively.

3. The multi-game system as claimed in claim 1, wherein the target board further comprises a plurality of top poles extending from the top end surface of the target board.

4. The multi-game system as claimed in claim 3, wherein the plurality of top poles is telescopic poles.

5. The multi-game system as claimed in claim 4, wherein each of the plurality of top poles comprises a detachable end cap.

6. The multi-game system as claimed in claim 5, wherein the target board further comprises a top net attached between the plurality of top poles.

7. The multi-game system as claimed in claim 1, wherein the pair of lower support legs is telescopic legs.

8. The multi-game system as claimed in claim 1, wherein the pair of upper support legs is telescopic legs.

9. The multi-game system as claimed in claim 8, wherein each of the pair of lower support legs comprises a first locking mechanism to prevent the pair of lower support leg from pivoting, and each of the pair of upper support legs comprises a second locking mechanism to prevent the pair of upper support legs from pivoting.

10. The multi-game system as claimed in claim 1, wherein the center support leg is a telescopic leg.

11. The multi-game system as claimed in claim 1, further comprising:

a base board;

the base board comprising a top surface, a bottom surface, an upper end surface, and a pair of opposite sidewalls;

a plurality of base legs extending from the bottom surface of the base board, adjacent to the upper end surface of the base board, such that the top surface is oriented at an angle with respect to a ground surface.

12. The multi-game system as claimed in claim 11, wherein the base board further comprises a ramp board having a top surface, front end surface, and a pair of opposite sidewalls, and wherein the top surface of the base board further comprises a cutout portion that has a shape complementary to the ramp board such that the top surface of the base board and the top surface of the ramp board form a planar surface when the ramp board is received within the cutout portion.

13. The multi-game system as claimed in claim 12, wherein the ramp board is tiltable relative to the base board such that the top surface of the ramp board is oriented at an angle with respect to the top surface of the base board.

14. The multi-game system as claimed in claim 13, wherein the base board further comprises an angle adjustment mechanism, the angle adjustment mechanism comprising a first adjustment pin on a sidewall of the ramp board, a second adjustment pin on a sidewall of the base board, and an angle adjustment bar having a plurality of adjustment holes to receive the first adjustment pin and the second adjustment pin.

15. The multi-game system as claimed in claim 14, wherein the first adjustment pin and second adjustment pin are threaded, and each of the first adjustment pin and second adjustment pin is provided with a wingnut to hold the angle adjustment mechanism in position.

16. The multi-game system as claimed in claim 15, wherein the base board further comprises a ramp board locking mechanism, the ramp board locking mechanism comprising a first locking pin on the front end surface of the ramp board, a second locking pin on the upper end surface of the base board, and a locking bar having two locking holes to receive the first locking pin and the second locking pin respectively.

17. The multi-game system as claimed in claim 16, the first locking pin and the second locking pin are threaded, and each of the first locking pin and the second locking pin is provided with a wingnut to lock the ramp board in the cutout portion.

18. The multi-game system of claim 1, wherein the pair of lower support legs is pivotable to a storage position in which the pair of lower support legs is parallel to the sidewalls of the target board.

19. The multi-game system of claim 18, wherein the pair of upper support legs is pivotable to a storage position in which the pair of upper support legs is parallel to the sidewalls of the target board.

20. The multi-game system of claim 19, wherein the center support leg is pivotable to a storage position in which the center support leg abuts against the back surface of the target board.

* * * * *